US008550782B2

(12) United States Patent
Hoskins

(10) Patent No.: US 8,550,782 B2
(45) Date of Patent: Oct. 8, 2013

(54) PARTIAL RING COOLING FAN

(75) Inventor: David R. Hoskins, Marshall, MI (US)

(73) Assignee: BorgWarner Inc., Auburn Hills, MI (US)

( * ) Notice: Subject to any disclaimer, the term of this patent is extended or adjusted under 35 U.S.C. 154(b) by 440 days.

(21) Appl. No.: 12/867,945

(22) PCT Filed: Feb. 18, 2009

(86) PCT No.: PCT/US2009/034384

§ 371 (c)(1),
(2), (4) Date: Dec. 30, 2010

(87) PCT Pub. No.: WO2009/105460

PCT Pub. Date: Aug. 27, 2009

(65) Prior Publication Data

US 2011/0094460 A1 Apr. 28, 2011

Related U.S. Application Data

(60) Provisional application No. 61/030,547, filed on Feb. 21, 2008.

(51) Int. Cl.
*F01D 5/22* (2006.01)

(52) U.S. Cl.
USPC ..... 416/191; 416/235

(58) Field of Classification Search
USPC ..... 416/191, 192, 235, 237, 238, 236 R, 416/236 A
See application file for complete search history.

(56) References Cited

U.S. PATENT DOCUMENTS

| | | | | |
|---|---|---|---|---|
| 4,802,771 | A * | 2/1989 | Weetman | 366/270 |
| 4,815,938 | A | 3/1989 | Brown | |
| 5,330,040 | A | 7/1994 | Drennen | |
| 5,405,243 | A | 4/1995 | Hurley et al. | |
| 5,564,901 | A * | 10/1996 | Moore | 416/91 |
| 6,024,537 | A * | 2/2000 | Moreau et al. | 416/192 |
| D446,295 | S | 8/2001 | Williams et al. | |
| 6,302,650 | B1 | 10/2001 | Williams et al. | |
| 6,375,427 | B1 | 4/2002 | Williams et al. | |
| 6,565,320 | B1 | 5/2003 | Surls et al. | |
| 6,626,640 | B2 | 9/2003 | Ivanovic | |
| 6,827,547 | B2 | 12/2004 | Robb | |

FOREIGN PATENT DOCUMENTS

| | | |
|---|---|---|
| EP | 1873355 | 1/2006 |
| JP | 2003531341 | 10/2003 |
| WO | WO 01/79704 | 10/2001 |

* cited by examiner

*Primary Examiner* — Dwayne J White

(57) ABSTRACT

A cooling fan with partial ring members attached to the blade tips. The fan preferably is a one-piece molded fan with a central hub and a plurality of blade members. Partial ring members on the blade tips reduce weight and minimize potential failures caused by knit lines and operations at high rotational speeds.

14 Claims, 5 Drawing Sheets

PARTIAL RING COOLING FAN

TECHNICAL FIELD

The present invention relates to cooling fans, particularly fans driven by or for use in cooling industrial or automotive engines.

BACKGROUND OF THE INVENTION

In most industrial and automotive engine applications, an engine-driven cooling fan is utilized to blow or draw air across a coolant radiator or heat exchanger. Usually the fan is driven through a belt-drive mechanism connected to the engine crankshaft.

A typical cooling fan has a plurality of blades mounted to a central hub or hub plate. The hub provides a rotary connection to the belt drive mechanism, for example. The size and number of the fan blades is determined by the cooling requirements for the particular application. For instance, a small automotive fan may only require four blades and have a diameter of less than 300 mm. In larger applications, such as heavy-duty automotive applications, particularly trucks and buses, nine blades or more can be utilized in the fan design and the fan can have an outer diameter of 600 mm or more.

In addition to the number of blades and diameter of the fan, the cooling capacity of a particular fan is also governed by the air flow volume that can be generated by the fan at its operating speed. The air flow volume is dependent upon the particular blade geometry, such as the blade area and curvature or profile, and the rotational speed of the fan. As the cooling fan dimensions and air flow capacity increase, the loads experienced by the fan, and particularly the blades, also increase. In addition, higher rotational speeds and increased air flow through the fan can lead to twisting of the blade and increased noise levels.

In order to address these problems to some degree, certain cooling fan designs incorporate a ring around the circumference of the fan. Specifically, the blade tips are attached to a 360° ring. The ring provides stability to the blade tips and also helps reduce vortex shedding at the blade tips, particularly when the ring is combined with a shroud. The ring also provides increased strength to the fan design and improves the vibration characteristics.

Ring fan designs, therefore, eliminate some of the structural difficulties encountered with unsupported cooling fan configurations. However, in the automotive and industrial cooling environment today wherein the fans need to have less weight and yet provide increased performance characteristics, the operating conditions for these fans has been increased to again push the envelope of the ring fan's capability.

One of the problems with ring-type fans is that in today's environment many fans are molded in one-piece and made of a plastic material. The injection molding process inherently produces weak points in the fan ring caused by plastic knit lines. Also, the centrifugal force exerted on the blade-ring interface caused by the mass inertia of the complete circumferential ring at increased fan speeds, can cause failure of molded fans at that interface.

Consequently, a need has developed for ways to improve the cooling air flow capacity of fans, particularly molded ring-type fans, while at the same time increasing their strength and preventing possible failures. This need becomes particularly acute for large industrial and automotive engines, where the fans are larger and have more mass, and as the operational rotational speeds of the fans increase to meet the increasing cooling demands.

SUMMARY OF THE INVENTION

To address these needs, the present invention contemplates an engine-driven cooling fan for use in an engine cooling system, in which the fan has a unique ring-type structure. The fan includes a central hub and a plurality of fan blades projecting radially outwardly from the hub, each of the blades having a blade root where they connect to the hub and a blade tip at the opposite end. Each of the blades further defines a leading edge at the inlet side of the fan and a trailing edge at the outlet side of the fan. The cooling fan also includes a partial circumferential ring connected to the blade tips of each of the plurality of fan blades.

The present invention achieves the operational and performance benefits and attributes of a 360° ring fan, but does not include many of its disadvantages or possible weak points where possible failures may occur.

A portion of a circumferential ring is connected to each of the blade tips. Each of the partial ring members is, in one embodiment, approximately the same length as the width or tip of the fan blade. The axial width of the partial ring members also can extend approximately the same extent as the axial extent of the blades. The partial ring members also, in one embodiment, do not completely cover the entire width or extent of the blade tip, but leave a portion of the trailing edge of the blade in a free state.

The partial ring members can have a planar configuration or can have other cross-sectional configurations, such as "V"-shaped or curved. The circumferential ends of the partial ring members can also be formed parallel to the axis of the fan, or can be formed at an angle to that axis.

Other objects, advantages and benefits of the present invention can be discerned from the following written description and accompanying drawings, when considered together with the appended claims.

DESCRIPTION OF PREFERRED EMBODIMENTS

Figure 1:
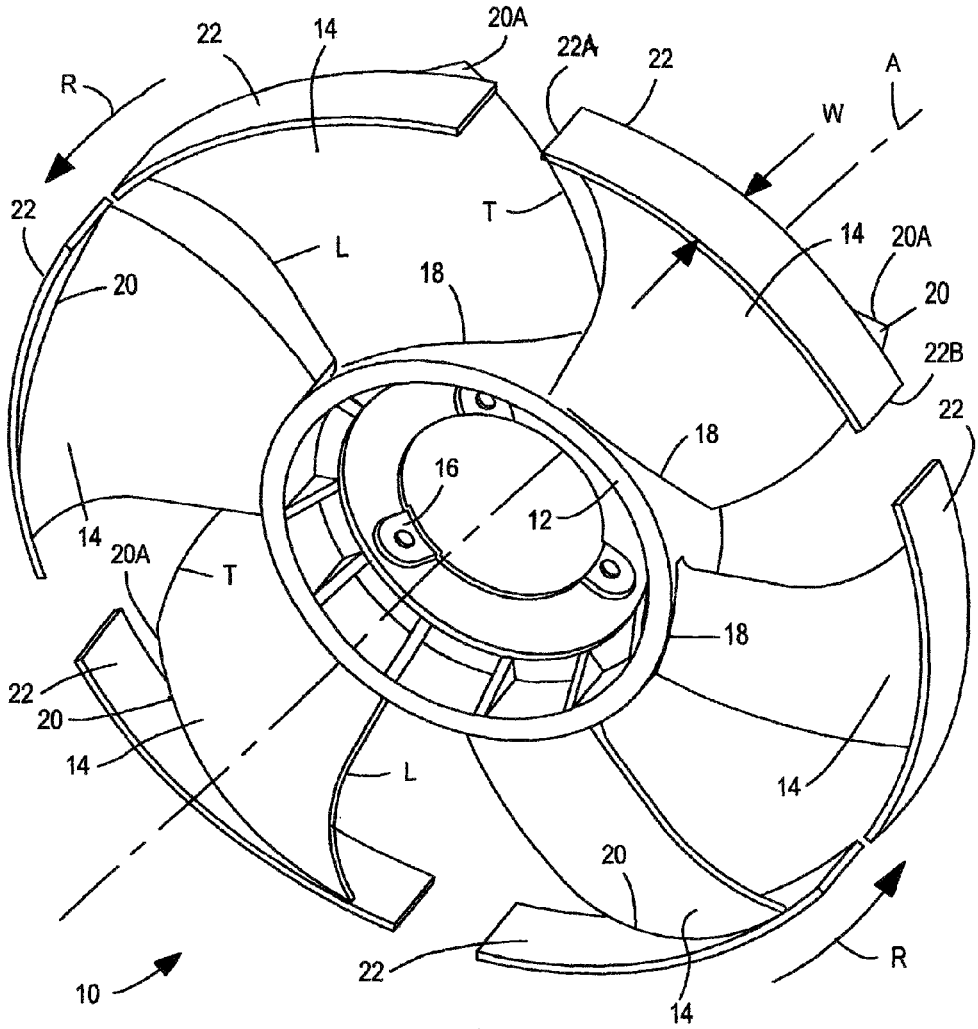
FIG. 1 is a perspective view of a partial ring cooling fan in accordance with an embodiment of the present invention.

For purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Also, the present invention will be described with particular reference to its use in a cooling system for an automotive or vehicle, particularly a heavy duty vehicle, such as a truck or bus. It is to be understood, however, that the invention is not limited to use in such applications. Instead, the present invention should be entitled to its full scope in accordance with the drawings and claims and for use in any application in which a cooling fan is utilized in a cooling system.

One embodiment of the invention utilizing a partial ring cooling fan is depicted in FIG. 1 and identified by the reference numeral 10. The fan 10 includes a central hub member 12 and a plurality of blade members 14 attached to the hub member. The hub member 12 can include a mounting bolt ring 16 configured to mount the fan to a fan drive assembly of known design.

Each of the fan blade members 14 is attached to the hub member at its root 18. Each of the fan blade members also includes a blade tip 20 at the end opposite the root 18.

Partial ring members 22 are attached to the blade tips of each of the blade members 14, as shown in FIG. 1.

The partial ring cooling fan 10 of FIG. 1, as thus far described, can be constructed in a known manner. For instance, the entire structure shown in FIG. 1 can be formed of a high strength moldable polymer material that is preferably injected molded about a metallic hub plate member 16, and utilizing a conventional known injection molding process. Conventional plastic injection molding techniques are in use today with respect to one-piece plastic molded cooling fans, with or without circumferential ring members positioned thereon.

In this regard, when one-piece cooling fan members are molded of a plastic material and the cooling fan has a full 360° circumferential ring thereon, weld (or knit) lines are typically created in the outer ring between each of the blades due to being the last area to fill. These weld lines create an area of weakness and can lead to separation and failure of the ring under certain conditions. Also, stresses caused by the mass inertia of a full 360° ring member on the blade members at the blade tips can also cause separation of the ring from the blades and thus failure of the cooling fan under certain conditions. These conditions of failure, either for the knit lines or at the intersection of the circumferential ring with the blade tips are typically caused by high local stresses and reduced material properties.

In the drawings (FIGS. 1-3), the direction of rotation of the cooling fans is shown by the arrows labeled R. In addition, the axis of rotation of the fans, that is the longitudinal axis of the fan cooling systems, is indicated by the letter A. For reference purposes, each of the blade members has a leading edge L and a trailing edge T. Also, the partial ring members 22 have a certain "width" W which is a distance measured in the direction of the axis A of the cooling fan. The actual number of blade members 14 is dependent upon the size of the fan and the cooling application or system in which the fan is utilized. For example, in FIG. 1, six blade members are depicted, while in FIGS. 2 and 3, five blade members are depicted. The actual number of blade members and the diameter of the cooling fan is not critical in accordance with the present invention. Thus, the present invention applies to any type of partial ring fan, regardless of the diameter of the fan and the number of blade members provided.

The fan blade members 14 can also be of any cross-sectional size and shape. The blade members can have a flat planar configuration or can be curved in any of the conventional configurations utilized for blade members today. For example, the blade members 14 can have a uniform cross-section across their widths or can vary in a conventional manner. They also can have an air-foil shape. The blade members also have a uniform thickness from their roots 18 to their tips 20, or again the thickness can vary in the radially outward direction of the blade members from the roots to the tips. In this regard, the blade members preferably have air foil-type configuration adapted to provide maximum air flow when the partial ring cooling fan is operated within its standard rotational speed and operational range.

In the embodiment of the invention shown in FIG. 1, each of the partial ring members 22 have a flat or planar cross-sectional configuration and the ends 22A and 22B of each of the partial ring fan members are also planar and provided in an orientation parallel to the longitudinal axis A of the cooling fan 10. In this regard, to prevent unbalance and undesired forces which could be harmful to the durability and performance of the cooling fan 10, substantially the same partial ring fan members and blade members should be provided around the circumference of the cooling fan. Thus, all of the blade members 14 and partial ring fan members 22 are precisely the same around the circumference of the hub 12.

In one embodiment, the width W of the partial ring fan member 22 is the same dimension as the overall axial extent of the blade members in the axial direction of the cooling fan. It is also possible, of course, in other embodiments, to have the width of the partial ring fan members be greater or less than the axial extent of the blade members.

Also, as shown in FIG. 1, a portion 20A of each of the tips 20 of the blade members 14 is not supported by, or thus disconnected from, the partial ring fan members 22. This feature can be provided in order to minimize the width W of the partial ring fan members, thus saving in material and weight of the cooling fan and partial ring members. Allowing a portion 20A of the blade tips 20 to not be connected to the partial ring fan members does not degrade or reduce the operation or efficiency of the cooling fan.

Figure 2:
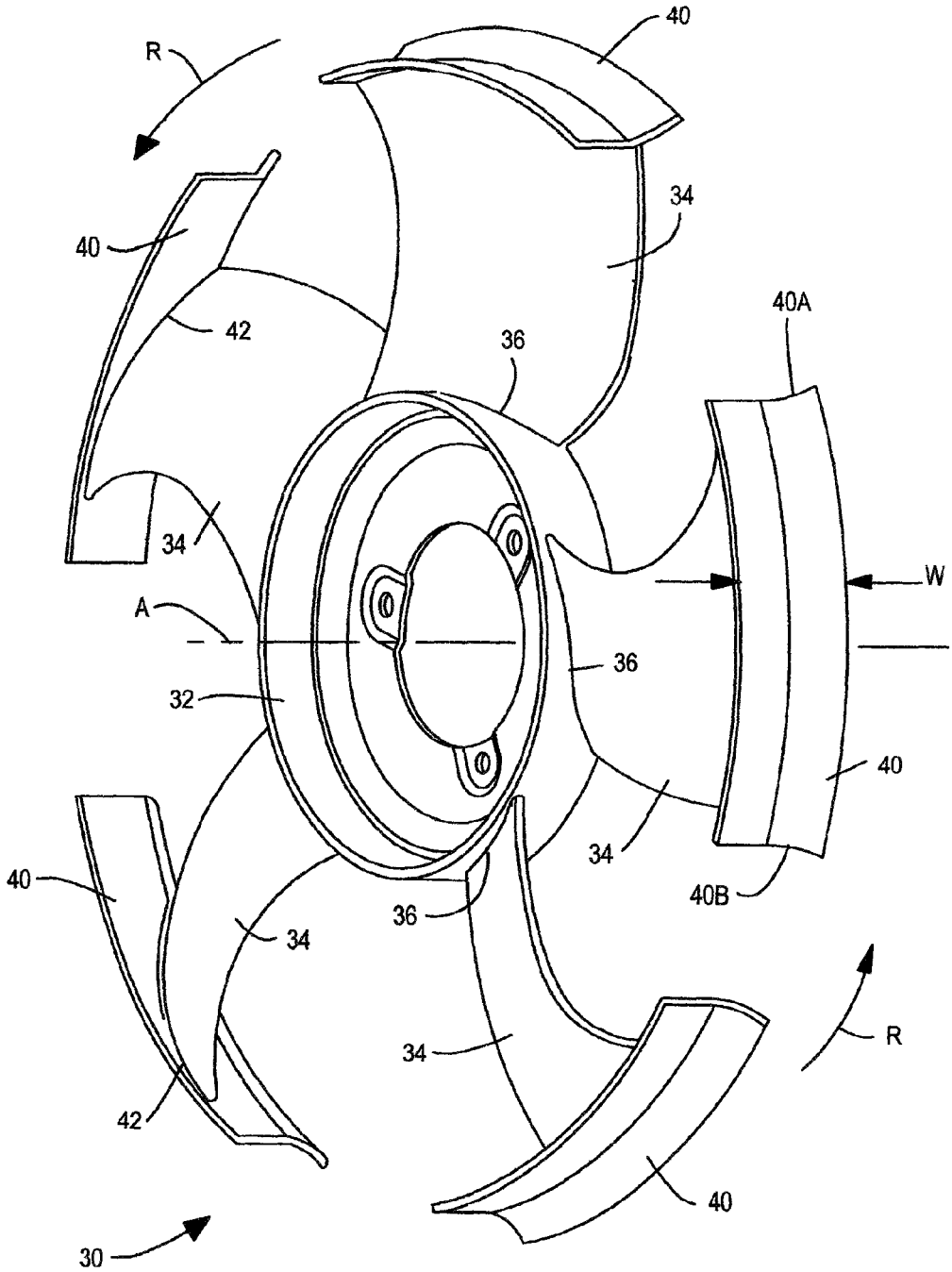
FIG. 2 is a perspective view of a partial ring cooling fan in accordance with another embodiment of the present invention.

Another embodiment of the present invention is shown in FIG. 2 and designated by the reference numeral 30. In this embodiment, the cooling fan member has a central hub 32 and a plurality of blade members 34 attached to the hub. The blade members 34 are attached to the central hub 32 at their roots 36. Each of the blade members also have a partial ring fan member 40 attached to the tips 42 of each of the blade members 34.

Each of the partial ring members 40 have essentially V-shaped cross-sectional configuration, as shown in FIG. 2. This can provide added benefits from an operational and performance standpoint for the cooling fan 30. In addition, in the embodiment shown in FIG. 2, the ends 40A and 40B of each of the partial ring members 40 are parallel to the longitudinal axis A of rotation of the cooling fan. The partial ring members 40 also extend the full length of the blade tips 42 of each of the blade members 34. The width W in the axial direction of the cooling fan 30 also is greater than the axial dimensional extent of the blade members.

Figure 3:
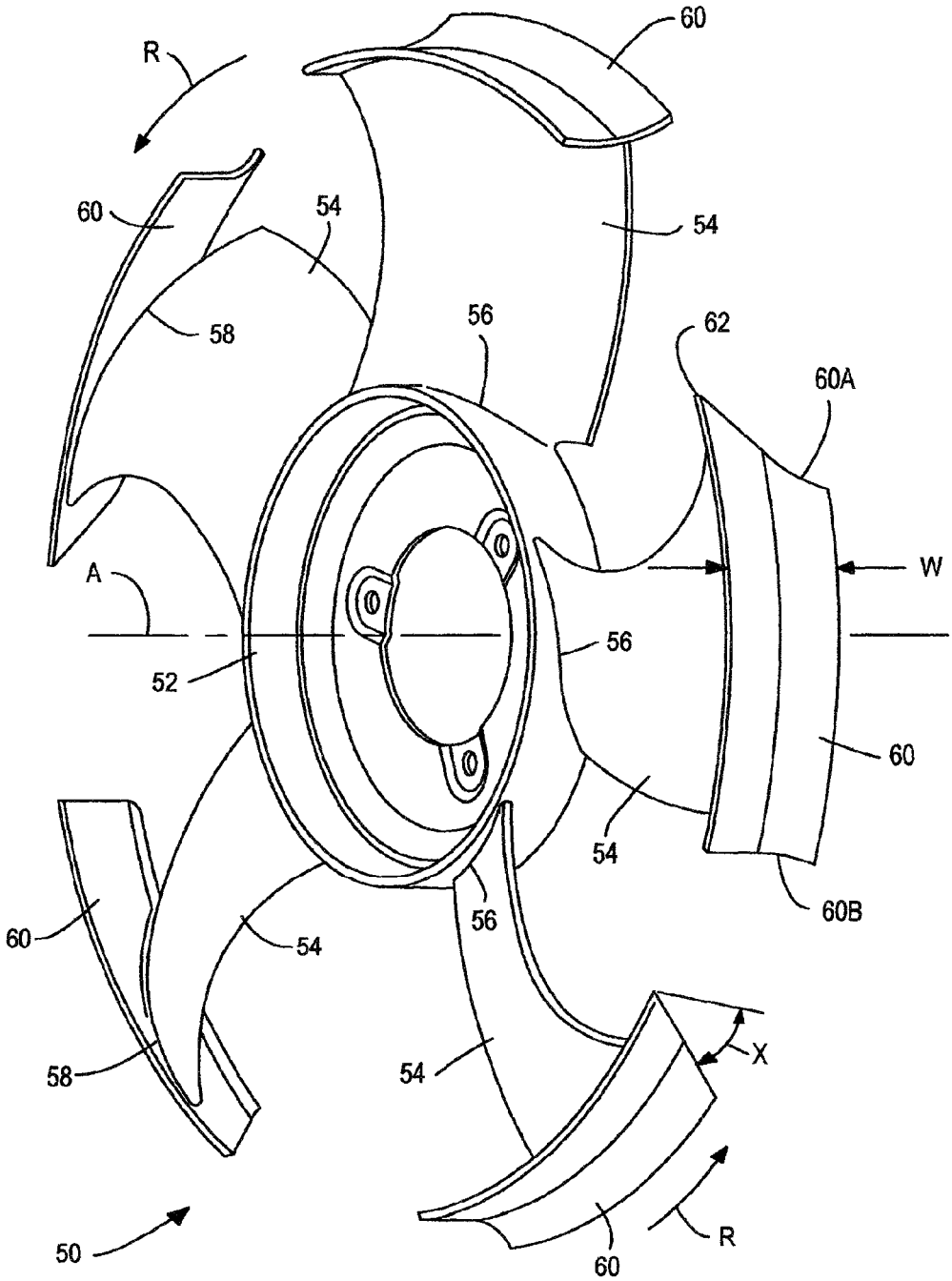
FIG. 3 is a perspective view of a partial ring cooling fan in accordance with still another embodiment of the present invention.

Still another embodiment of the present invention is shown in FIG. 3. This cooling fan is identified generally by the reference numeral 50. The cooling fan 50 includes a central hub member 52 and a plurality of fan blade members 54. Each of the blade members 54 has a root 56 which is attached to the central hub and a blade tip 58.

A partial ring fan member 60 is attached to the tips 58 of each of the blade members 54. In this embodiment, the partial ring fan members 60 have a curved generally U-shaped configuration as shown. In this regard, the U-shaped configuration can be either a concave or convex shape relative to the hub.

Also, the ends 60A and 60B of each of the partial ring fan members 60 is provided at an angle X relative to the axis of rotation A of the cooling fan 50. In particular, as shown in FIG. 3, the leading corner 62 of the angled end 60A of the partial ring fan member 60 is provided such that it leads the partial ring fan member 60 in the direction of rotation R of the cooling fan 50.

Figure 4:
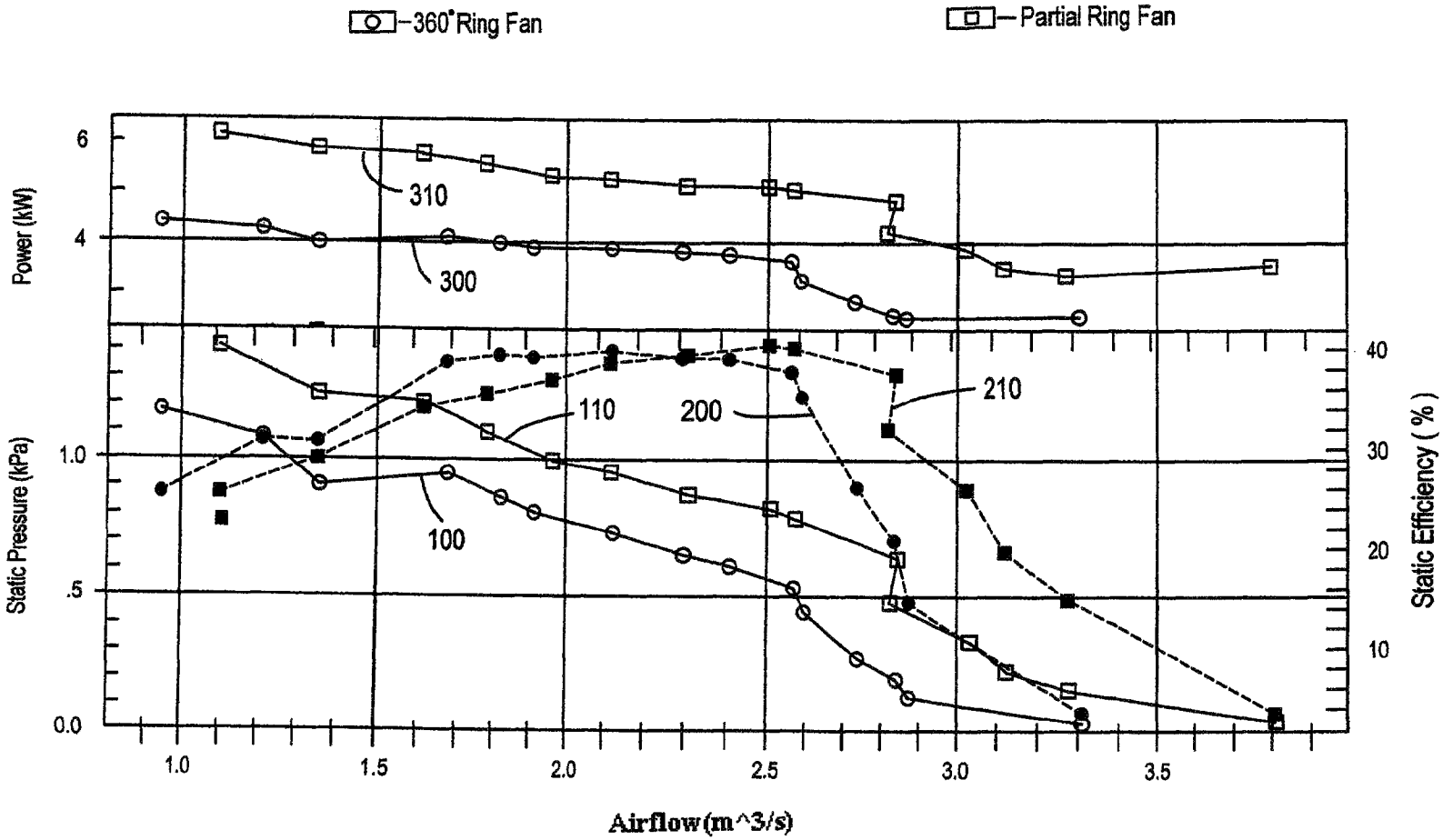
FIG. 4 is a graph illustrating the performance characteristics of a cooling system utilizing the present invention versus prior art cooling systems.
Figure 5:
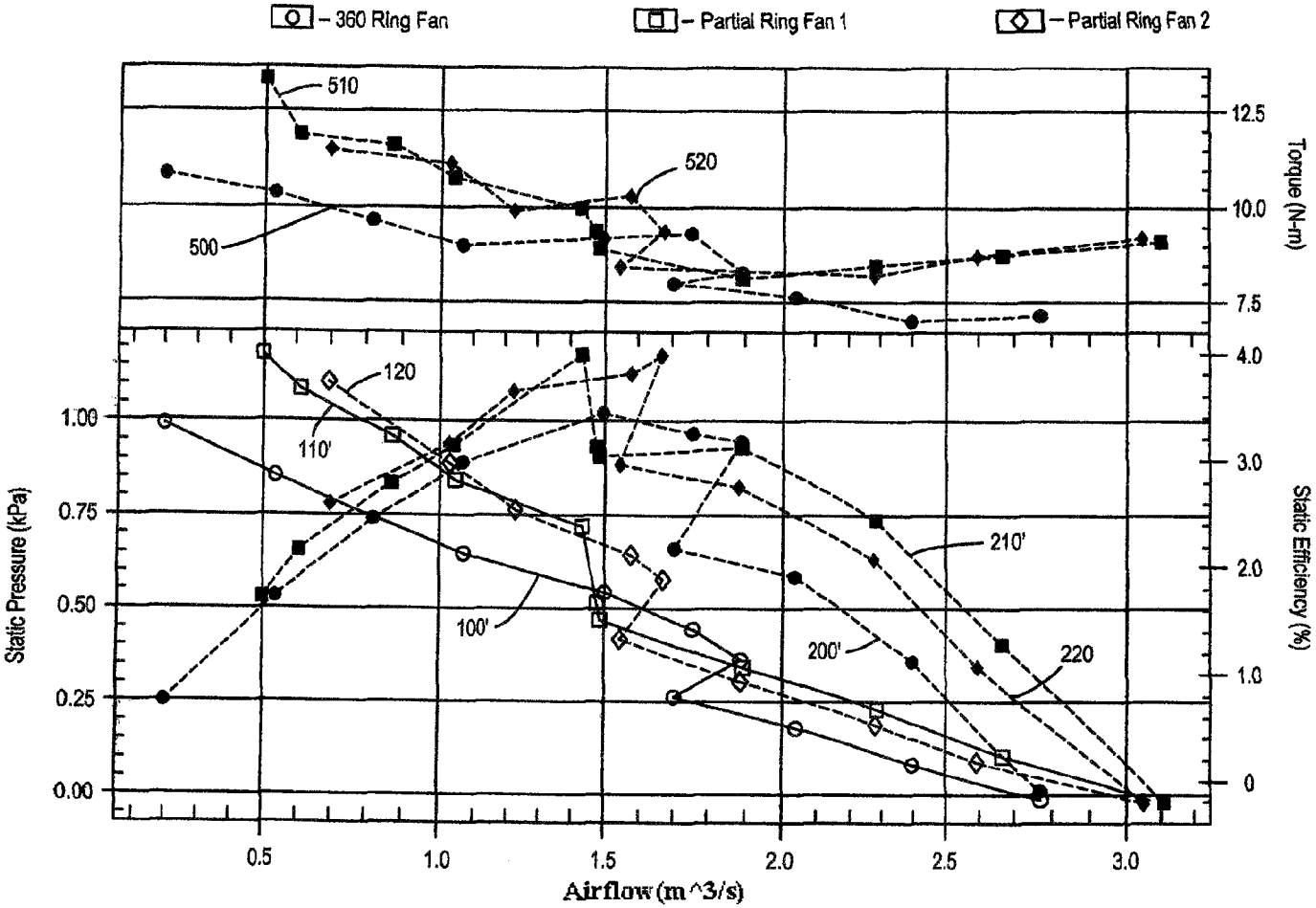
FIG. 5 is a graph illustrating the performance characteristics of two cooling systems utilizing fan embodiments in accordance with the present invention in comparison with a prior art cooling system using a prior art cooling fan.

FIGS. 4 and 5 graphically illustrate a comparison of static pressure, static efficiency, torque, and power versus air flow utilizing the partial ring inventions as described above, in comparison of those characteristics with prior art ring fans which have complete 360° rings thereon. Lines 100, 100', 110, 110' and 120 plot a comparison static pressure to air flow with cooling systems, while lines 200, 200', 210, 210' and 220 plot static air efficiencies versus air flow. Further, lines 300 and 310 plot power versus air flow and lines 500, 510 and 520 plot torque output versus airflow.

All of the lines shown in the graphs in FIGS. 4 and 5 that have circles designating the plotted points, relate to tests done on a ring fan which has a complete 360° ring attached to the blade tips. This is a prior art-type ring fan. The graph lines which are indicated by small squares, plot the performance of partial ring fans in accordance with the embodiments of the invention shown in FIGS. 1-2. Finally, the graph lines indicated by small diamonds for the plotted points shown in FIG. 5 plot the performance of another partial ring fan embodiment, in particular the partial ring fan embodiment shown in FIG. 3. This partial ring fan has partial ring members with ends which are angled relative to the central axis of the fan.

As one of ordinary skill in the art understands, the output velocity of the air flow, expressed in meters per second from the fan, has a rotational component of motion. This is due to the rotation of the fan blades in the direction R and a linear component $V_x$ induced by the pitch of the fan blades. Furthermore, with the particular blade form and blade disposition, the variation and pitch along the blade span, or the cord length of the blade (taken along a radial cross-section) will affect the status pressure distribution provided immediately adjacent to the fan, and hence will effect the flow of air which is passed through the fan.

As shown in FIG. 4, a fan structure with partial ring members 110 has a greater static pressure 110 than a ring fan 100 with an entire 360° ring. In addition, although the static efficiency 210 of a partial ring fan in accordance with the present invention is slightly lower at lower air flow rates than a 360° ring fan 200, the static efficiency of a partial ring fan with partial ring members in accordance with the present invention is greater than the static efficiency of a prior art ring 360° ring fan at higher air flow rates. Thus, with the present invention, static pressure and static efficiency at given air flow as compared with cooling systems having conventional ring fans is better. Such air flow increases at a given static pressure are accomplished without adversely effecting the torque levels as shown in comparing lines 500 and 510 in FIG. 5. This leads to increased static efficiency at higher air flows as shown by a comparison of lines 200 and 210 in FIG. 4. Similar increases are shown by each of the two partial ring fan embodiments in FIG. 5 compared with conventional 360° ring fans.

As shown in FIG. 5, the torque attributes of each of the partial ring fans 510 and 520 are similar and are similarly not adversely affected by use of the partial ring fan members rather than a 360° ring.

These improvements are attributed to the expectation that the partial ring reduces blade tip vortices while allowing more radial flow to occur.

As one of ordinary skill in the art appreciates, the static efficiency is the ratio of the fan output to mechanical power into the fan, which is flow times pressure over torque times speed. From this, the amount of horsepower required to drive the fan can be calculated. Thus, as the static efficiency increases at a given input of rotational speed (i.e. torque), the horsepower required to drive the fan decreases. This leads to increased fuel economy associated with the torque decrease.

Thus, the present invention provides improved efficiency or flow while reducing fan weight and manufacturing issues relative to ring fans. Also, the arrangement of the present invention provides equivalent noise levels given equivalent airflow relative to full ring fans, thus maintaining customer satisfaction.

A dimensional relationship between the partial ring configuration for a given blade geometry for optimal performance is believed to exist.

While the invention described in connection with various embodiments, it will be understood that the invention is not limited to those embodiments. On the contrary, the invention covers all alternatives, modifications, and equivalents as may be included within the spirit and scope of the appended claims.

What is claimed is:

1. An engine driven cooling fan for an engine cooling system, said cooling fan having improved efficiencies and performance comprising:

a central hub member;

a plurality of blade members attached to said hub member and extending radially therefrom; each of said blade members having a tip portion thereon; and a plurality of partial ring members, one of said partial ring members being positioned on and connected to the tip portion of each of said blade members;

said partial ring members each being curved in a circumferential circular orientation;

wherein each of said partial ring members has a substantially V-shaped cross-sectional configuration.

2. The fan for an engine cooling system as described in claim 1 wherein each of said blade members have a maximum dimension in the circumferential circular duration, and the partial ring members each have a circumferential length no greater than said maximum circumferential dimension.

3. The fan for an engine cooling system as described in claim 1 wherein each of said blade members have a maximum dimension in the axial direction of the fan, and the partial ring members each have an axial width W no greater than said maximum axial dimension.

4. The fan for an engine cooling system as described in claim 1 wherein at least one portion of each of said tip portions is not connected to said partial ring member which is positioned thereon.

5. The fan for an engine cooling system as described in claim 1 wherein said partial ring members each have two end members, and the end members are oriented substantially in the axial direction of the fan.

6. The fan for an engine cooling system as described in claim 1 wherein said partial ring members each have two end members, and at least one of the end members is oriented at an angle to the axial direction of the fan.

7. The fan for an engine cooling system as described in claim 6 wherein each of the end members is oriented at an angle to the axial direction of the fan.

8. An engine driven cooling fan for an engine cooling system, said cooling fan having improved efficiencies and performance comprising:

a central hub member;

a plurality of blade members attached to said hub member and extending radially therefrom; each of said blade members having a tip portion thereon; and a plurality of partial ring members, one of said partial ring members being positioned on and connected to the tip portion of each of said blade members;

said partial ring members each being curved in a circumferential circular orientation;

wherein each of said partial ring members has a substantially U-shaped cross-sectional configuration.

9. The fan for an engine cooling system as described in claim 8 wherein each of said blade members have a maximum dimension in the circumferential circular duration, and the partial ring members each have a circumferential length no greater than said maximum circumferential dimension.

10. The fan for an engine cooling system as described in claim 8 wherein each of said blade members have a maximum dimension in the axial direction of the fan, and the partial ring members each have an axial width W no greater than said maximum axial dimension.

11. The fan for an engine cooling system as described in claim 8 wherein at least one portion of each of said tip portions is not connected to said partial ring member which is positioned thereon.

12. The fan for an engine cooling system as described in claim 8 wherein said partial ring members each have two end members, and the end members are oriented substantially in the axial direction of the fan.

13. The fan for an engine cooling system as described in claim 8 wherein said partial ring members each have two end members, and at least one of the end members is oriented at an angle to the axial direction of the fan.

14. The fan for an engine cooling system as described in claim 13 wherein each of the end members is oriented at an angle to the axial direction of the fan.

* * * * *